US008210833B2

(12) United States Patent
Egawa et al.

(10) Patent No.: US 8,210,833 B2
(45) Date of Patent: Jul. 3, 2012

(54) MOTOR-DRIVEN COMPRESSOR

(75) Inventors: Satoru Egawa, Aichi-ken (JP); Ken Suitou, Aichi-ken (JP); Shinya Nakamura, Aichi-ken (JP)

(73) Assignee: Kabushiki Kaisha Toyota Jidoshokki, Aichi-ken (JP)

( * ) Notice: Subject to any disclaimer, the term of this patent is extended or adjusted under 35 U.S.C. 154(b) by 607 days.

(21) Appl. No.: 12/479,084

(22) Filed: Jun. 5, 2009

(65) Prior Publication Data

US 2009/0304536 A1 Dec. 10, 2009

(30) Foreign Application Priority Data

Jun. 9, 2008 (JP) ..... 2008-150746

(51) Int. Cl.
*F04B 35/04* (2006.01)
*F04B 35/00* (2006.01)

(52) U.S. Cl. ..... 417/423.14; 417/410.1; 417/415; 417/420; 417/423.7

(58) Field of Classification Search ..... 417/410.1, 417/411, 415, 416, 420, 423.7, 423.8, 423.14
See application file for complete search history.

(56) References Cited

U.S. PATENT DOCUMENTS

| | | | | |
|---|---|---|---|---|
| 6,755,631 | B2 * | 6/2004 | Kawashima et al. | 417/572 |
| 2002/0057971 | A1 * | 5/2002 | Shida et al. | 417/410.1 |
| 2005/0074343 | A1 * | 4/2005 | Naito | 417/423.3 |

FOREIGN PATENT DOCUMENTS

| | | | |
|---|---|---|---|
| JP | 03-264780 | A | 11/1991 |
| JP | 2001-182655 | A | 7/2001 |
| JP | 2005-307798 | A | 11/2005 |

* cited by examiner

*Primary Examiner* — Joseph L Williams
*Assistant Examiner* — Nathaniel Lee
(74) *Attorney, Agent, or Firm* — Sughrue Mion, PLLC

(57) ABSTRACT

A motor-driven compressor includes a terminal housing made of an electrically insulating material and accommodating therein an electrical connecting portion which includes a connecting terminal connecting to a conductive member and an electric wire. The compressor includes a first seal member and a second seal member to seal the inside of the terminal housing from the outside thereof. The terminal housing has a distance-increasing portion that increases the communicating distance from a compressor housing to the electrical connecting portion in the terminal housing. The distance-increasing portion allows the pressures in the terminal housing and the compressor housing to be equalized.

6 Claims, 3 Drawing Sheets

MOTOR-DRIVEN COMPRESSOR

BACKGROUND OF THE INVENTION

The present invention relates to a motor-driven compressor.

In motor-driven compressors, generally, a hermetic terminal is provided. Japanese Unexamined Patent Application Publication No. 2005-307798 discloses a hermetic terminal that is composed of a terminal base disposed in a through-hole formed in a compressor housing, a conductive member for electrically connecting an electric motor and an inverter, and an insulating member supporting the conductive member on the terminal base while insulating the conductive member from the terminal base. The conductive member is connected to a cluster block in the compressor housing. The cluster block has a terminal housing accommodating therein an electrical connecting portion that includes a connecting terminal connecting to the conductive member and an electric wire extending from the electric motor.

In such motor-driven compressors, when the operation is stopped, refrigerant gas existing in the compressor housing is cooled and condensed, and liquid refrigerant may remain in the compressor housing, accordingly. In such a case, if any part of the conductive member is soaked in the liquid refrigerant, electrical conduction between the conductive member and the compressor housing may be caused by the liquid refrigerant, and electrical insulation between the conductive member and the compressor housing may not be maintained. When the compressor is started in such condition, current supplied to the conductive member may leak to the compressor housing through the liquid refrigerant.

To prevent such current leakage, Japanese Unexamined Patent Application Publication No. 2001-182655 discloses a motor-driven compressor, according to which part of the conductive member and the insulating member in the compressor housing are covered with an insulating resin, whereby the insulation distance between the conductive member and the compressor housing is increased and the conductive member is insulated from the compressor housing.

It is suggested to seal the inside of the terminal housing from the outside thereof to prevent liquid refrigerant from entering into the terminal housing. By so doing, electrical conduction between the compressor housing and the electrical connecting portion in the terminal housing through the liquid refrigerant is prevented, and the electrical insulation therebetween is maintained, accordingly. However, since the terminal housing is hermetically closed by sealing the inside of the terminal housing from the outside thereof, the liquid refrigerant remaining in the compressor housing may cause a pressure difference between the terminal housing and the compressor housing, and the terminal housing may be damaged by the pressure difference. To reduce such pressure difference, it is suggested to form an opening in the terminal housing for fluid communication between the terminal housing and the compressor housing thereby to equalize the pressures in the terminal housing and the compressor housing. However, current supplied to the conductive member may leak to the compressor housing through any liquid refrigerant entering into the terminal housing through the opening, and electrical insulation between the compressor housing and the electrical connecting portion in the terminal housing may not be maintained.

The present invention is directed to providing a motor-driven compressor that allows the pressures in a terminal housing and a compressor housing to be equalized and also maintains electrical insulation of the compressor housing from an electrical connecting portion in the terminal housing.

SUMMARY OF THE INVENTION

In accordance with an aspect of the present invention, a motor-driven compressor includes a compression mechanism for compressing refrigerant, an electric motor for driving the compression mechanism, a compressor housing made of a metal, accommodating therein the compression mechanism and the electric motor and formed with a through-hole, a conductive member extending through the through-hole and electrically connected to the electric motor, a terminal base disposed in the through-hole, an insulating member supporting the conductive member on the terminal base while insulating the conductive member from the terminal base, a connecting terminal electrically connected to the conductive member, an electric wire for electrically connecting the connecting terminal and the electric motor, a terminal housing made of an electrically insulating material, accommodating therein an electrical connecting portion which includes the connecting terminal connecting to the conductive member and the electric wire and having a first hole through which the conductive member is inserted and a second hole through which the electric wire is inserted, a first seal member provided between the terminal housing and the insulating member to seal the inside of the terminal housing from the outside thereof, and a second seal member provided between the second hole and the electric wire to seal the inside of the terminal housing from the outside thereof. The terminal housing has a distance-increasing portion that increases the communicating distance from the compressor housing to the electrical connecting portion in the terminal housing. The distance-increasing portion allows the pressures in the terminal housing and the compressor housing to be equalized.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

Figure 1A:
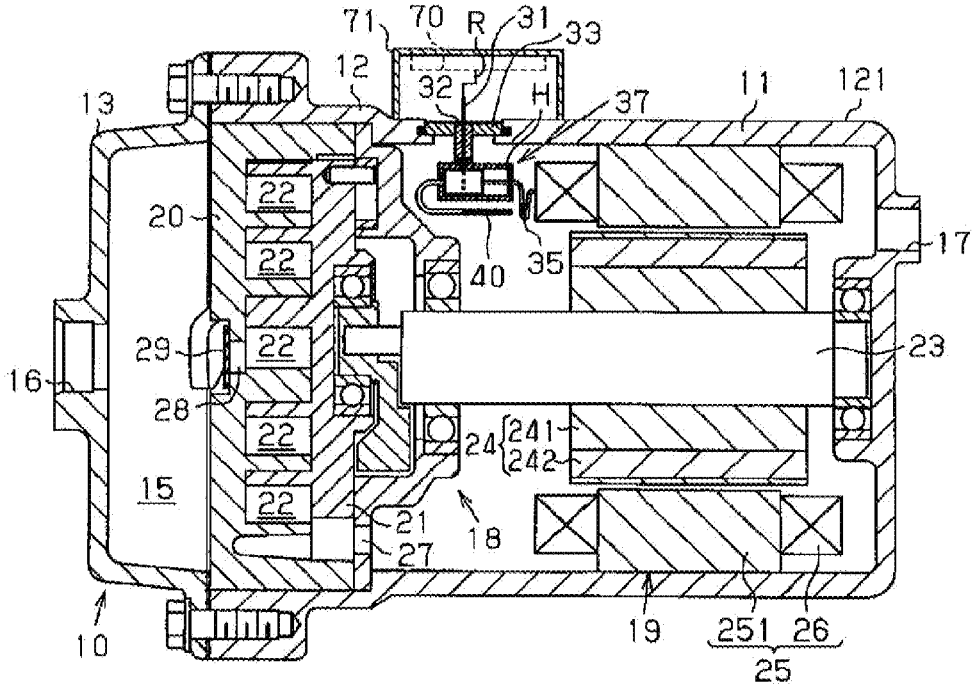
FIG. 1A is a longitudinal sectional view of a motor-driven compressor according to a first embodiment of the present invention.
Figure 1B:
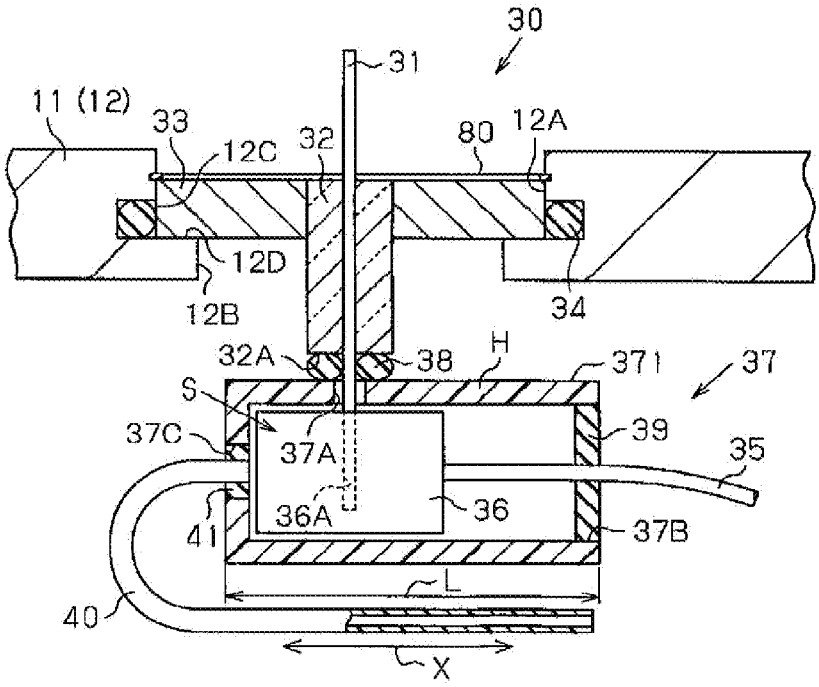
FIG. 1B is a fragmentary enlarged view of an electrical connecting portion between a metal terminal and a connecting terminal of the motor-driven compressor of FIG. 1A.

The following will describe the motor-driven compressor according to the first embodiment of the present invention with reference to FIGS. 1A and 1B. Referring to FIG. 1A, the motor-driven compressor 10, which is of a scroll type, has a compressor housing 11 made of a metal and composed of a first housing member 12 and a second housing member 13. The second housing member 13 forms therein a discharge chamber 15, and the end wall of the second housing member 13 is formed therethrough with an outlet port 16. The end wall of the first housing member 12 is formed therethrough with an inlet port 17. The outlet port 16 and the inlet port 17 are connected to an external refrigerant circuit (not shown). The first housing member 12 accommodates therein a compression mechanism 18 and an electric motor 19 that drives the compression mechanism 18 for compressing refrigerant gas.

The compression mechanism 18 includes a fixed scroll 20 and a movable scroll 21. The fixed scroll 20 is fixedly mounted to the first housing member 12. The movable scroll 21 is disposed so as to face the fixed scroll 20 to form a compression chamber 22 therebetween, the volume of which is variable. The movable scroll 21 is coupled to a rotary shaft 23 supported by the first housing member 12.

The electric motor 19 includes a rotor 24 and a stator 25. The rotor 24 is fixedly mounted on the outer peripheral surface of the rotary shaft 23 for rotation therewith in the first housing member 12. The rotor 24 has a rotor core 241 mounted to the rotary shaft 23 and permanent magnets 242 mounted to the rotor core 241. The stator 25 is generally in the form of a ring and has a stator core 251 and a coil 26. The stator core 251 is fixedly mounted on the inner peripheral surface of the first housing member 12. The coil 26 is wound around the teeth (not shown) of the stator core 251.

The compressor 10 has a box-shaped inverter cover 71 mounted on the outer peripheral surface 121 of the first housing member 12. The inverter cover 71 is an electrically conductive member made of aluminum. With the inverter cover 71 mounted on the outer peripheral surface 121 of the first housing member 12, part of the outer peripheral surface 121 provides the bottom surface of the inverter cover 71. Thus, part of the outer peripheral surface 121 of the first housing member 12 cooperates with the inverter cover 71 to form a space that accommodates therein an inverter 70 (indicated by dashed line in FIG. 1A) for driving the electric motor 19.

In the above-described compressor 10, when power is supplied to the electric motor 19, the rotor 24 of the electric motor 19 is rotated with the rotary shaft 23 to drive the compression mechanism 18. While the compression mechanism 18 is in operation, the volume of the compression chamber 22 between the fixed and movable scrolls 20 and 21 is varied, and refrigerant gas is introduced from the external refrigerant circuit via the inlet port 17 into the first housing member 12. The refrigerant gas then flows via an inlet passage 27 into the compression chamber 22 and compressed therein. After being compressed, the refrigerant gas is discharged via a discharge passage 28 into the discharge chamber 15 while pushing open a discharge valve 29. The refrigerant is further discharged out of the compressor 10 via the outlet port 16, then flowing through the external refrigerant circuit and back into the first housing member 12.

Referring to FIG. 1B, a through-hole 12A is formed in the side wall of the first housing member 12. The through-hole 12A has a small diameter portion 12B, a large diameter portion 12C located outward of the small diameter portion 12B as seen in radial direction of the compressor housing 11, and a step 12D located between the small diameter portion 12B and the large diameter portion 12C. The through-hole 12A is closed by a terminal base 33 made of a metal and constituting a part of the side wall of the compressor housing 11. The terminal base 33 is supported on the step 12D and fitted in the large diameter portion 12C of the through-hole 12A. The terminal base 33 is prevented by a circlip 80 from being removed out from the large diameter portion 12C of the through-hole 12A. A seal member 34 is provided between the inner peripheral surface of the large diameter portion 12C and the outer peripheral surface of the terminal base 33 to seal therebetween. A metal terminal 31 is supported by the terminal base 33 through an insulating member 32. The metal terminal 31 is a conductive member for electrically connecting the electric motor 19 and the inverter 70. The insulating member 32 is made of glass and insulates the metal terminal 31 from the terminal base 33. The metal terminal 31, the insulating member 32 and the terminal base 33 constitute a hermetic terminal 30.

The compressor housing 11 accommodates therein a cluster block 37. The cluster block 37 is located inward of the hermetic terminal 30 as seen in the radial direction of the compressor housing 11. In the present embodiment, the cluster block 37 includes a box-shaped terminal housing H that is made of an electrically insulating material such as a synthetic resin. The side wall of the terminal housing H is formed therethrough with a first hole 37A, and one of the end walls of the terminal housing H as seen in longitudinal direction (indicated by arrow X in FIG. 1B) is formed therethrough with a second hole 37B. The metal terminal 31 of the hermetic terminal 30 is inserted through the first hole 37A into the terminal housing H. The terminal housing H accommodates therein a connecting terminal 36 that is electrically connected to the metal terminal 31. The connecting terminal 36 is electrically connected to an electric wire 35 in the terminal housing H. The electric wire 35 extends from the connecting terminal 36 out of the terminal housing H through the second hole 37B, and is electrically connected to the electric motor 19 (see FIG. 1A). One end of the metal terminal 31 is inserted in a hole 36A of the connecting terminal 36 for electrical connection therewith, and the other end of the metal terminal 31 is electrically connected to the inverter 70 via an electric wire R, as shown in FIG. 1A. Thus, the terminal housing H of the cluster block 37 accommodates therein an electrical connecting portion S that includes the connecting terminal 36 connecting to the metal terminal 31 and the electric wire 35.

The terminal housing H of the cluster block 37 has an outer surface 371 having the first hole 37A and facing the end surface 32A of the insulating member 32, and a first seal member 38 is disposed between the outer surface 371 and the end surface 32A. The first seal member 38 is provided so as to cover the metal terminal 31 between the outer surface 371 of the terminal housing H and the end surface 32A of the insulating member 32. The first seal member 38 is in close contact with the outer surface 371 and the end surface 32A to seal therebetween. A second seal member 39 is disposed in the second hole 37B of the terminal housing H to seal between the inner peripheral surface of the second hole 37B and the electric wire 35.

The end wall of the terminal housing H opposite from the second hole 37B is formed therethrough with a hole 37C for allowing the interior of the terminal housing H to communicate with the interior of the compressor housing 11. The terminal housing H has a hose 40 made of an electrically insulating material such as a synthetic resin and extending outward from the hole 37C. One end of the hose 40 is inserted in the hole 37C of the terminal housing H, and the other end of the hose 40 is mounted on the inner peripheral surface of the compressor housing 11 via any suitable mounting (not shown) formed in the compressor housing 11. A seal member 41 is disposed between the inner peripheral surface of the hole 37C and the hose 40 to seal the inside of the terminal housing H from the outside thereof. The entire length of the hose 40 is greater than the length L of the terminal housing H as measured in longitudinal direction.

When the operation of the above-described compressor 10 is stopped, refrigerant gas existing in the compressor housing 11 is cooled and condensed, and liquid refrigerant may remain in the compressor housing 11, accordingly. In such a case, the first seal member 38 prevents electrical conduction between the compressor housing 11 and the metal terminal 31 through the liquid refrigerant, thus maintaining electrical insulation between the compressor housing 11 and the metal terminal 31. The interior of the terminal housing H is sealed against the interior of the compressor housing 11. In addition, the seal members 38, 39 and 41 prevent the liquid refrigerant from entering into the terminal housing H other than through the hose 40, so that electrical conduction due to such liquid refrigerant is prevented. Therefore, the electrical connecting portion S in the terminal housing H are insulated from the compressor housing 11. Further, though the terminal housing H is sealed by the seal members 38, 39 and 41, the pressure in the compressor housing 11 is introduced into the terminal housing H through the hose 40, and the pressures in the terminal housing H and the compressor housing 11 are equalized. Still further, the provision of the hose 40 extending from the hole 37C out of the terminal housing H increases the length of the communicating path from the compressor housing 11 to the electrical connecting portion S in the terminal housing H because of the liquid refrigerant remaining in the hose 40. Thus, the hose 40 functions as a distance-increasing portion that increases the communicating distance of the liquid refrigerant from the compressor housing 11 to the inside of the terminal housing H. Therefore, the hose 40 prevents the liquid refrigerant from entering into the terminal housing H, and provides enough insulation distance that means a creepage distance from the compressor housing 11 to the electrical connecting portion S in the terminal housing H. The insulation distance also means the shortest distance from the compressor housing 11 through the hose 40 to the electrical connecting portion S in the terminal housing H. That is, the shortest distance means the entire length of the hose 40 plus the shortest distance from the compressor housing 11 to the end of the hose 40 opposite from the electrical connecting portion S.

The motor-driven compressor 10 according to the first embodiment offers the following advantages.

(1) The first seal member 38 is provided between the outer surface 371 of the terminal housing H and the end surface 32A of the insulating member 32 to seal therebetween. Since the first seal member 38 insulates the compressor housing 11 from the part of the metal terminal 31 existing in the compressor housing 11, current leakage from the metal terminal 31 to the compressor housing 11 through the liquid refrigerant is prevented. In addition, since the terminal housing H is sealed by the seal members 38, 39 and 41, current leakage from the electrical connecting portion S to the compressor housing 11 through the liquid refrigerant is also prevented. Therefore, the electrical connecting portion S in the terminal housing H can be insulated from the compressor housing 11. Further, the hose 40 connected to the hole 37C of the terminal housing H serves to equalize the pressures in the terminal housing H and the compressor housing 11. Therefore, the terminal housing H is protected from a damage due to the pressure difference between the terminal housing H and the compressor housing 11. Still further, since the hose 40 extends from the hole 37C out of the terminal housing H, the electrical connecting portion S in the terminal housing H can be insulated from the compressor housing 11.

(2) The entire length of the hose 40 is greater than the length L of the terminal housing H as measured in the longitudinal direction. In such a case, the length of the conduction path extending from the compressor housing 11 to the electrical connecting portion S in the terminal housing H becomes longer, as compared to a case wherein the entire length of the hose 40 is smaller than the length L of the terminal housing H. Therefore, the electrical connecting portion S in the terminal housing H can be insulated from the compressor housing 11.

The above embodiment may be modified in various ways as exemplified below.

Figure 2:
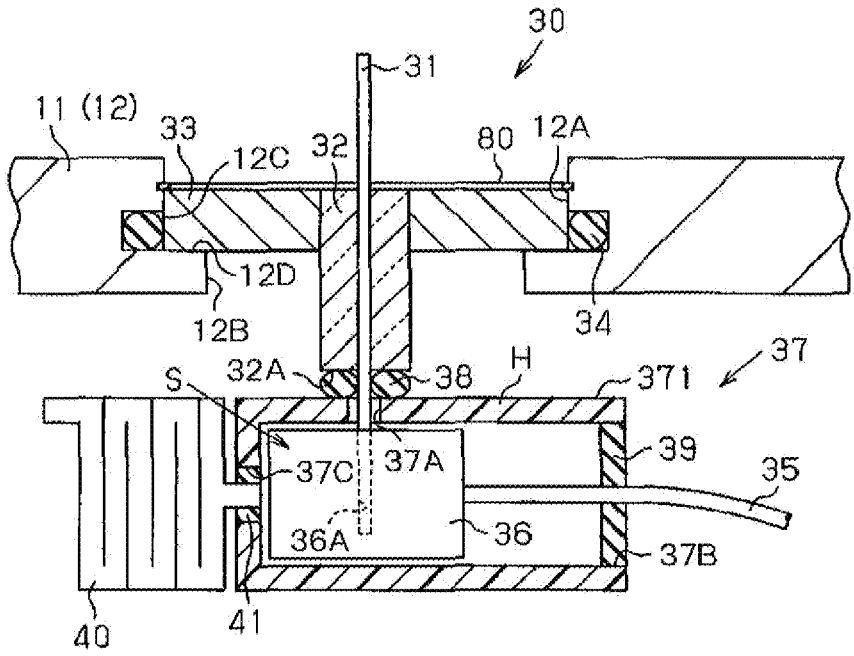
FIG. 2 is a view of another embodiment of a hose.

As shown in FIG. 2, the part of the hose 40 extending outside of the terminal housing H may be formed into a serpentine shape. The end of the hose 40 is mounted on the inner peripheral surface of the compressor housing 11, as in the case of the first embodiment. In such a case, the space for the hose 40 within the compressor housing 11 can be reduced, as compared to the hose 40 extending straight from the terminal housing H.

Figure 3:
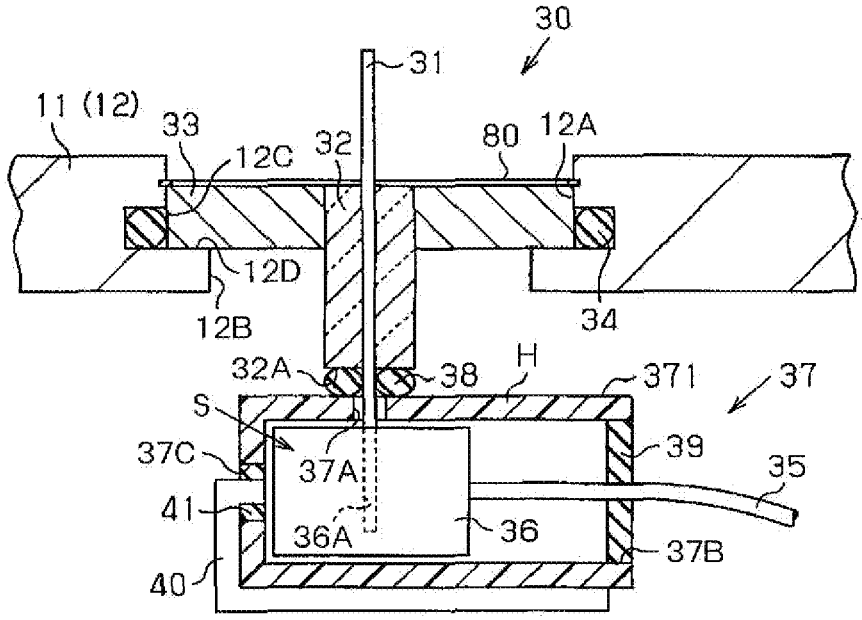
FIG. 3 is a view of another embodiment of a hose.

As shown in FIG. 3, the part of the hose 40 extending outside of the terminal housing H may be fixed on the outer surface of the terminal housing H. In such a case, the hose 40 is prevented from moving due to any vibration generated by the operation of the compressor 10, thereby preventing the hose 40 from interfering with the parts located around the cluster block 37 such as the compression mechanism 18 and the electric motor 19.

Figure 4:
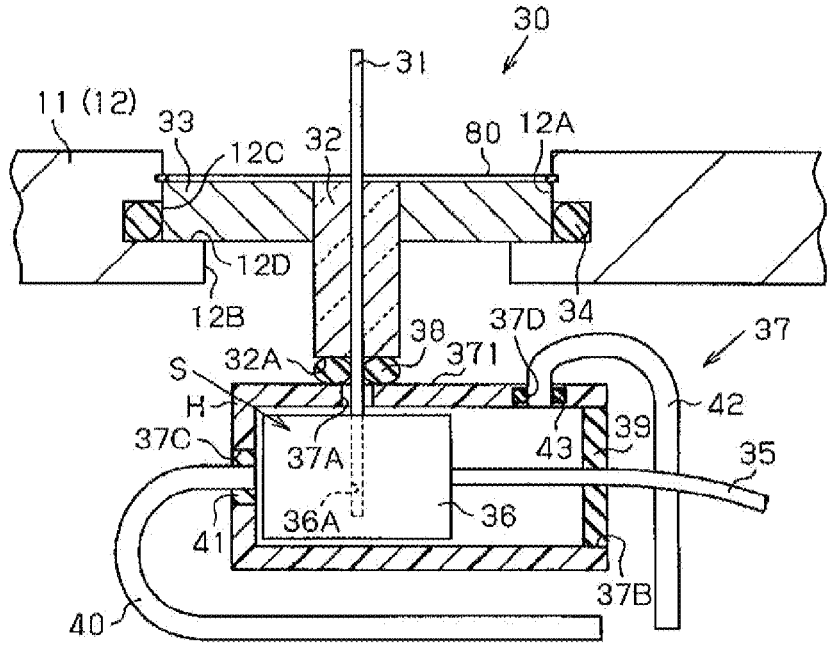
FIG. 4 is a view of another embodiment of a hose.

As shown in FIG. 4, an additional hose 42 extending from the terminal housing H may be provided. The hose 42 is made of an electrically insulating material such as a synthetic resin. The hose 42 extends from a hole 37D that is formed through the side wall of the terminal housing H in addition to the hole 37C. The hole 37D allows fluid communication between the interior of the terminal housing H and the interior of the compressor housing 11. One end of the hose 42 is inserted in the hole 37D, and a seal member 43 is disposed between the inner peripheral surface of the hole 37D and the hose 42 to seal the inside of the terminal housing H from the outside thereof. In such a case, the total cross-sectional area of the fluid path between the interior of the terminal housing H and the interior of the compressor housing 11 becomes larger, so that the pressure in the compressor housing 11 is introduced into the terminal housing H more quickly through the two hoses 40 and 42. As a result, the pressures in the compressor housing 11 and the terminal housing H can be equalized more quickly, as compared to a case wherein only the hose 40 is provided. Thus, a plurality of hoses such as the hoses 40 and 42 may be provided for the terminal housing H.

Figure 5:
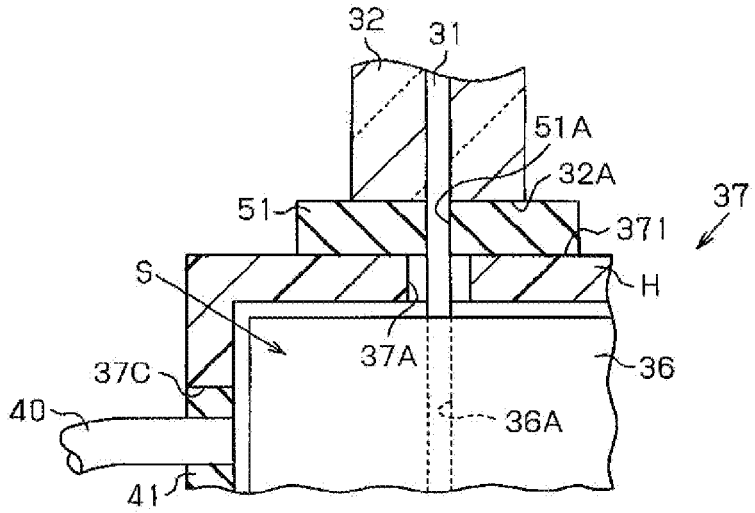
FIG. 5 is a view of another embodiment of a first seal member.

As shown in FIG. 5, a plate-shaped seal member 51 may be provided between the outer surface 371 of the terminal housing H and the end surface 32A of the insulating member 32. The seal member 51 is in close contact with the outer surface 371 and the end surface 32A to seal therebetween. The seal member 51 is mounted on the outer surface 371 of the terminal housing H and has a hole 51A through which the metal terminal 31 is inserted. Thus, a plate-shaped seal member may be used for the first seal member 38, as well as the O-ring.

The entire length of the hose 40 may be smaller than the length L of the terminal housing H as measured in the longitudinal direction.

The distance-increasing portion such as the hose 40 may be formed integrally with the terminal housing H. For example, when the terminal housing H is made of a synthetic resin, the distance-increasing portion in the form of a tube extending out from the terminal housing H may be formed integrally with the terminal housing H. Such distance-increasing portion may be formed into either a serpentine shape or a straight shape. In the case where the distance-increasing portion is formed integrally with the terminal housing H, a part of the housing accommodating the electrical connecting portion S corresponds to the terminal housing H, and a part extending out from the terminal housing H corresponds to the distance-increasing portion.

In each embodiment, the compression mechanism 18 is of a scroll type having the fixed and movable scrolls 20 and 21, but it may be of a piston type or a vane type.

What is claimed is:

1. A motor-driven compressor, comprising:

a compression mechanism for compressing refrigerant;

an electric motor for driving the compression mechanism;

a compressor housing made of a metal and accommodating therein the compression mechanism and the electric motor, the compressor housing formed with a through-hole;

a conductive member extending through the through-hole and electrically connected to the electric motor;

a terminal base disposed in the through-hole;

an insulating member supporting the conductive member on the terminal base while insulating the conductive member from the terminal base;

a connecting terminal electrically connected to the conductive member;

an electric wire for electrically connecting the connecting terminal and the electric motor;

a terminal housing made of an electrically insulating material and accommodating therein an electrical connecting portion which includes the connecting terminal connecting to the conductive member and the electric wire, the terminal housing having a first hole through which the conductive member is inserted and a second hole through which the electric wire is inserted;

a first seal member provided between the terminal housing and the insulating member to seal the inside of the terminal housing from the outside thereof; and a second seal member provided between the second hole and the electric wire to seal the inside of the terminal housing from the outside thereof, wherein the terminal housing has a distance-increasing portion that increases the communicating distance from the compressor housing to the electrical connecting portion in the terminal housing, the distance-increasing portion allowing the pressures in the terminal housing and the compressor housing to be equalized.

2. The motor-driven compressor according to claim 1, wherein the distance-increasing portion is formed into a serpentine shape.

3. The motor-driven compressor according to claim 1, wherein the distance-increasing portion is in the form of a tube communicating the inside of the terminal housing to the compressor housing and extending out from the terminal housing.

4. The motor-driven compressor according to claim 3, wherein the distance-increasing portion is fixed on an outer surface of the terminal housing.

5. The motor-driven compressor according to claim 1, wherein the terminal housing has a plurality of the distance-increasing portions which are extended out therefrom.

6. The motor-driven compressor according to claim 1, wherein the entire length of the distance-increasing portion is greater than the length of the terminal housing as measured in the longitudinal direction thereof.

* * * * *